US009429342B2

(12) United States Patent
Skomsvold

(10) Patent No.: US 9,429,342 B2
(45) Date of Patent: Aug. 30, 2016

(54) DEVICE AND METHOD FOR TRANSPORTING HEAT

(75) Inventor: Age Jorgen Skomsvold, Tonsberg (NO)
(73) Assignee: Rotoboost AS, Tonsberg (NO)

( * ) Notice: Subject to any disclaimer, the term of this patent is extended or adjusted under 35 U.S.C. 154(b) by 1472 days.

(21) Appl. No.: 12/937,611
(22) PCT Filed: Apr. 14, 2009
(86) PCT No.: PCT/NO2009/000142
§ 371 (c)(1),
(2), (4) Date: Dec. 6, 2010
(87) PCT Pub. No.: WO2009/128726
PCT Pub. Date: Oct. 22, 2009

(65) Prior Publication Data
US 2011/0067847 A1 Mar. 24, 2011

(30) Foreign Application Priority Data
Apr. 14, 2008 (NO) ..... 2008-1799

(51) Int. Cl.
*F25B 3/00* (2006.01)
*F25B 9/00* (2006.01)
(Continued)

(52) U.S. Cl.
CPC . *F25B 3/00* (2013.01); *F25B 9/00* (2013.01); *F28D 11/04* (2013.01); *F28D 7/0016* (2013.01)

(58) Field of Classification Search
CPC ..... F28D 11/02; F25B 3/00
USPC ..... 122/11
See application file for complete search history.

(56) References Cited

U.S. PATENT DOCUMENTS 3,748,057 A 7/1973 Eskeli
3,791,167 A * 2/1974 Eskeli ..... 62/401
(Continued)

FOREIGN PATENT DOCUMENTS

GB 936059 A 9/1963

OTHER PUBLICATIONS

International Preliminary Examining Authority, "International Preliminary Report on Patentability for PCT/NO2009/000142", Jun. 16, 2010, Publisher: IPEA/SE.
(Continued)

*Primary Examiner* — Steven B McAllister
*Assistant Examiner* — Rabeeul Zuberi
(74) *Attorney, Agent, or Firm* — Pitts & Lake, P.C.

(57) ABSTRACT

It is a purpose for the invention to provide a rotating device (107) to generate heat, cold and pressure from the outlet at the rotation axis, by centrifugation pressurized fluid in that it include at least two under-supported U-channel structures (107) where one of the channels (104, 105) from each U-channel structure (107) toward the periphery (107) is in thermal contact, forming a heat exchanger (106) where one of the channels (105) contains a compressible cooling fluid which develops heat from the centrifugal compression in the channel (105), and the heat is transferred to a heating fluid with a lower temperature in the second channel (104) in heat exchanger (106) toward the periphery (107) where heat exchanging ceases, and the U-channels (107) is connected to its inlet—(101, 102) and outlet channels (111, 112) at the rotation axis for the transport of said fluid through the U-channels (104, 105, 108, 109) via the periphery (107), which after the outlet (111) for heating fluid is heat-exploited, and cooling fluid (112) is cold-exploited, and the heating fluid before the outlet (111) is pressurized by the heat received in the heat exchangers (106), and the cooling fluid is compressed with an adapted circulation pressure before inlet (102) to compensate against emitted heat in heat exchangers (106), and an expansion work of the heating fluid reduces the supplied energy to the compression work of the cooling fluid, and U-channel structures is rotated by appropriate means, and the U-channels are arranged radial and in balance around the rotation axis.

9 Claims, 1 Drawing Sheet

(51) Int. Cl.
*F28D 11/04* (2006.01)
*F28D 7/00* (2006.01)

(56) References Cited

U.S. PATENT DOCUMENTS 3,809,017 A 5/1974 Eskeli
3,828,573 A * 8/1974 Eskeli ..... 62/401
4,044,824 A * 8/1977 Eskeli ..... 165/88
4,167,371 A * 9/1979 Eskeli ..... 417/53
6,196,020 B1 * 3/2001 Nowacki et al. ..... 62/499
6,699,608 B2 * 3/2004 Blaszczyk et al. ..... 429/413
2003/0089232 A1 5/2003 Eimer

OTHER PUBLICATIONS

Norwegian Patent Office, "Norwegian Search Report for Patent Application No. 20081799", Mar. 2, 2010, Published in: Norway.
International Searching Authority, "International Search Report for PCT/NO2009/000142 ", Sep. 7, 2009, Publisher: Swedish Patent Office.

* cited by examiner

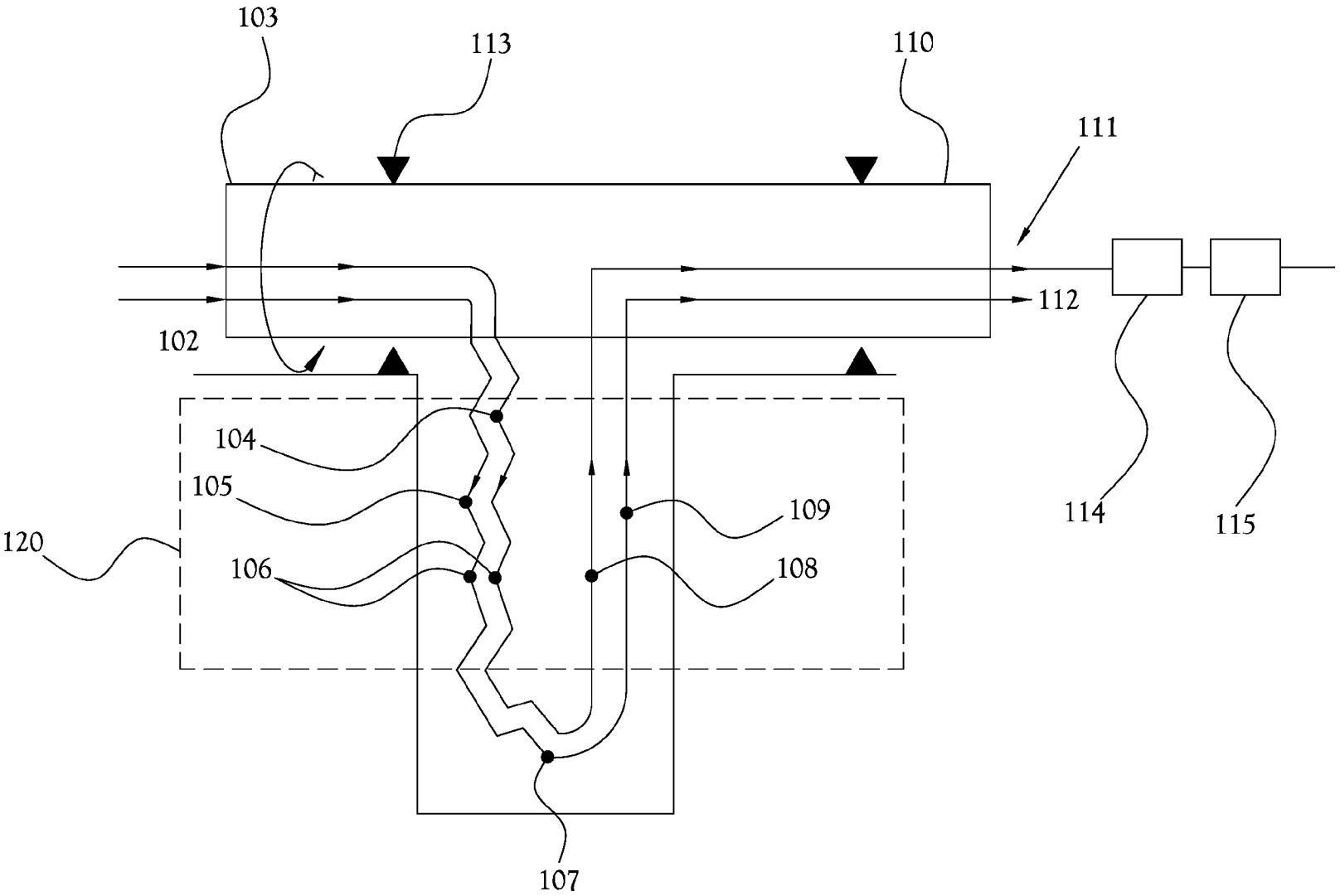
115
114
111
112
110
109
108
107
113
103
104
105
106
102
120

DEVICE AND METHOD FOR TRANSPORTING HEAT

FIELD OF THE INVENTION

The present invention relates to generation of heat in a pressurized fluid by means of centrifugal force.

TECHNICAL BACKGROUND

There are known devices which are rotating in order to utilize the centrifugal force to compress a fluid, which then is heated and deliver the heat to another fluid or medium at the periphery of the device.

Common for these devices is that one of the fluids drive the device via nozzles located at the periphery and that the fluid is transported through the device only by centrifugal force.

As the pressure difference is large between the inside and outside of said nozzles at the periphery, a high velocity is created in the fluid, with corresponding large friction and turbulence. In case the nozzles are turned backward in the direction of rotation, this will that also create rotation resistance and friction. The result of the said will reduce the efficiency.

When the fluid is a gas that is relatively moist; the gas when emitting heat to the other fluid will condensate the water because of the reduction in temperature and increase in pressure. Further, the enthalpy of the condensed liquid will reduce the temperature fall in the gas after said periphery nozzles. This will reduce cooling efficiency.

The nozzles at periphery are optimum adapted for a fluid at a specific temperature and pressure at one rotational speed. This will also result in bad flexibility.

SUMMARY OF THE INVENTION

It is an object of the invention to obtain a rotating device for transporting heat which avoids the above said disadvantages of prior art devices.

This is attainable with a device and method according to the invention as it appears from the following claims.

In the present invention efficiency is enhanced among other in that the inlet and outlet are primarily at the rotation axis where the fluid is transported to/from the periphery through channels, and in that there may be more than two fluids wherein at least one of them is compressible to provide heat. A compressible fluid may exchange heat directly with another incompressible fluid in fog-form outward to the periphery. The rotation device is mounted in bearings in a surrounding evacuated housing with sealing.

BRIEF REVIEW OF THE DRAWING

The invention will now be described in detail which according to the drawing, where:

FIG. 1 shows a principle sketch of a longitudinal axial section of an embodiment of the invention; only two U-channel structures are shown on one side of the rotation axis; the opposite side of the rotation axis will be symmetrical equal to the side shown.

DETAILED DESCRIPTION

FIG. 1 shows the principal parts of the invention, namely a cylindrical drum or disc-like structure, or discs with tracks/shovel, or pipes assembled radial or axially surrounding the rotational axis, or a combination of the aforementioned to form U-channel structures 107 that are connected to inlet channels 101, 102 at the shaft inlet end 103, and outlet channels 111, 112 at the shaft outlet 110. Shaft ends 103, 110 are suspended in bearings 113, and connected with drive means which is adapted to rotate the U-channel structures (not shown). The structure includes an inlet channel 101 for supply of heating fluid from the centre of the shaft 103 to sink channel 104, which surrounds the shaft end 103 of the inlet channel 102 for supply of cooling fluid to its sink channel 105, which further may surround or otherwise be in thermal contact with the heating fluid sink channel 104 that may be mounted on it with heat exchange gills. The heating fluid sink channel 104 may also include heat gills for better heat exchange, and this form a heat exchanger 106 between the sink channels 104, 105, and for reinforcement of the structure. If the fluids has the same temperature before the inlet, and the cooling fluid in its sink channel 105 is more compressible due to centrifugal force, and in addition has lower cp against the hot fluid in its sink channel 104, the cooling fluid will be warmer and transfer heat to the heating fluid continuously on its way towards the periphery 107, where the heat exchange stop, and the fluids flow further, heat insulated from each other, from the periphery inwards to the rotation axis in the rise channel of the heating fluid 108 and the rise channel of the cooling fluid 109 and to their outlet in which the heating fluid outlet channel 111 is enclosed by the cooling fluid outlet channel 112 at the end of the outlet shaft 110. Then the cooling fluid is used for cooling and the heating fluid for heating. For adjusted flow of the cooling fluid, an adjusted pressure must be provided before the inlet 102 to counteract higher gravity density in its rise channel 109 which provides a higher centrifugal force against its sink channel 105. And for the heating fluid it will be opposite, thus forming an overpressure at the outlet 111, and the gravity density in its rise channel 108 will be lower than in the sink channel 104, and by adjusted pressure regulation (not shown) at the outlet 111, or by making the heating fluid pass an adapted turbine/turbo-charger that will provide roughly the same work as the said adjusted pressure of the cooling fluid before inlet 102. The cooling fluid's outlet can also be arranged radial extended outward to achieve the said circulation, but this provides less efficiency. The channels 104-106 and 108-109 include branches represented at 120.

The fluid inlet channels 101, 102 and outlet channels 111, 112 can be arranged to enclose their shaft ends 103, 110 (not shown), or that the shaft is a adapted tube that is closed in the middle with a tight wall, and one of the inlet channels can be used for one of the ends, and the other end for the outlet channels. Pipe ends are connected to their respective sink- and rise channels.

Said U-channel structures or sink channels 104, 105 or riser channels 108, 109 can be adapted to be bent radial fully or partially backward of the rotation direction (not shown).

Channel from the inlet to the outlet that is not in a closed system as mentioned later, the precipitated material and some fluid may pass through a row of adapted nozzles over the periphery 107, into a circular disc shaped jektor diffusor (not shown) along the outer surface of the periphery and the series of nozzles of the rotation device/U-channel structures, which receives material from the series of nozzles, which forms low pressure within the evacuated housing (not shown) that do not rotate and that jektor diffusor is attached to, and in the evacuated housing is the U-channels arranged radial and in balance around the rotation axis where it at inlet and outlet is sealed and suspended in bearings to said anchored evacuated housing, where the low pressure/vacuum reduce rotation resistance.

Said materials which are precipitated can be dust and water, if for example moist air is used at the inlet 102. It may also be added an adjusted amount of atomized water or another incompressible medium or liquefied fluid (not shown) to the fluid/air at the inlet 102; atomization of the medium is maintained by allowing it to pass tangential in adapted channels in or around shovels or pipes which atomizes the medium continuous outward towards the periphery. The medium/water will have a spiral-shaped and tangential motion outwards, through the fluid/air that flow in a more radial way. The medium/water which forms a relatively large surface area receives fast and direct heat from the fluid/air, and possibly in addition indirectly from another cooling fluid from the sink channel 105 which also maintains the temperature fully or partially of which the heating fluid would have had without the medium/water in the channel 104. By adjusted optimal atomization of the medium/water, so that it is suspended longer in the fluid, it will increase the pressure and temperature towards the periphery 107, where it should be a adapted axial channel length so that the medium/water can be precipitated and the speed is slowed and further led over the periphery 107 in the said nozzles. Where the medium/water and some other fluid, after said jektor diffusor are separated and will have a high pressure which, among other things, can be used fully or partially to participate in the device's rotation and/or circulation of fluids/mediums or other energy converting. Warm water can be exploited after it may have performed its work of pressure after the jektor diffusor. By using only air as a cooling fluid which is added by water fog, becomes a heating fluid from the inlet, as said, it will also fetch water from the air, and more at a higher temperature and higher relative humidity.

One of the fluids can flow opposite of what has been mentioned so far. It will then form a counter flow heat exchanger 106. Current solution requires that the heating fluid are such that no/or limited scope emits heat to the cooling fluid inward towards the rotation axis of the heat exchanger 106. This is eliminated if the channels are temperature-insulated from each other with suitable material from a radius point and radial inward from the cooling fluid becomes colder against the heating fluid. With the counter-solution flow the heating fluid in the channel 109 must also be thermally insulated against the cooling fluid's channel 108.

Both heating fluid channels from inlet 101 to outlet 111 and cooling fluid channels 102, 112 or one of the fluid channels may be in a closed circuit (not shown) where the fluid is led in each channel to its heat exchanger, either in channels from the shaft ends with adapted tightening against external and static channels and heat exchangers, or fluid is led in the channels to and from each side of the rotating device's shaft ends via mounted cylindrical centric end heat exchangers with adapted circular/disc-like heat gill on outside, where a heat exchange medium, which can be ambient air from the surroundings, that will flow into a channel radial/tangentially over the outer surface of the rotating heat exchangers in a fan-like house, and the air leaves the fan casing in a channel tangentially/radial opposite direction on the other side of a partition wall that is mounted to the fan casing and the mediums inlet/outlet channels and parallel to the shaft and with tracks for the circular cooling gill, which have been built radial against the rotor heat exchanger with small clearance between it and the cooling gill where the air will receive heat from the heating fluid side, and cold from the cooling fluid heat exchanger on the opposite end of the rotation device's shaft. By using adapted clearance between the cooling gills and that they are adapted for it, the rotor heat exchanger can perform circulation of the heat exchange medium/air, and it also provides a relatively large surface area which is advantageous for the heat-exchanging and the heat exchangers also becomes compact. The fluids can with a closed circuit also adapt to a higher pressure, which makes the inventive device more compact. In this case, with closed circuit for both fluids, there is no need for jektor diffusor, and low pressure within the evacuated housing must then be performed with suitable resources, such as a vacuum pump. Because of the circulation of the cooling fluid, it must be performed with appropriate resources as mentioned later.

By using a disc like rotating device which contains said U-channels, the bearing and shaft could be constructed axially on one side of the rotary device with at least two bearings. It is also beneficial if there is a rotary device at each end of the shaft for the elimination of the axially forces and that the inlet 101, 102, is free from the shaft.

In a closed circuit the cooling fluid must also have a pressure for circulation which is adapted in relation to self-circulation of the heating fluid, and the best heat exchange effect is when the compressor is connected after the heat exchanger for the cool—and possibly the heating fluid, as in the case with the said external heat exchangers, a compressor can be arranged in the closed circuit before the inlet of the cooling fluid, or the compressor is arranged in suspended bearings in the rotation device with a centrifugal rotor with shovels in front of the cooling mediums sink channel with significantly smaller radius than the sink channel, and where the centrifugal rotor has a higher rotation than the device in the same direction and the refrigerant which is sling in resultant load radial and tangential can also drive the rotation of the U-channel device when the refrigerant is received in its sink channels. It can also be in this way with an open circuit. The rotation operation of the centrifugal rotor performed with suitable means such as its shaft stretched out into the inlet, or through the shaft to the rotation devices other shafts end with bearing and sealing between, where the rotor shaft is connected to a motor directly and/or via a gear, and/or any of the rotational energy is supplied through a turbine from the heating fluid's pressure/circulation, and the turbine is connected to the centrifugal rotor's shaft. It can also be an axial turbine connected in front of the inlet of the cooling fluid, with attached shaft with sealing in the rotating device's shaft where the turbine shaft connects to an axial turbine connected after the outlet of the heating fluid. Turbine shaft is further in contact to suitable means for supply of residual energy to maintain constant rotation of both the rotating device's U-channels and turbines, or the pressure in the fluid can be increased. The advantage of this solution is that the inlet/outlet may have a smaller radius, being converging/diverging and the axially velocity of the fluids which can be high without significant losses, and the radial velocity decreases with larger cross-sectional area, both outward and inward from the periphery 107. The evacuation of air and refilling of the appropriate fluid to their channels, which also can be adapted to pressurized, can be performed with a suitable valve arranged at the rotation axis of each fluid, or pressure tank as mentioned later.

At least one disc or tubular heat exchanger 106 (not shown) that is transverse on—and centered around the rotation axis, and containing at least one circular channel at the periphery 107 for cooling fluid and at least one circular channel for heating fluid, where the supply channel from the inlet for cooling fluid is connected to the cooling fluid channel/is in the heat exchanger closest to the rotation axis, and connected into the periphery from cooling fluid circle channel in the heat exchanger and to the rotation axis and to the outlet. Heating fluid circle channels in the current heat exchanger can be connected the same way as the said cooling fluid circle channels and the flow direction can be the same or opposite of the cooling fluid. At the opposite flow direction of fluids, the cooling fluid in the cooling fluid circle channel will try to keep its slow peripheral speed outwards against the periphery, and it forms a circulation relative against to the rotation direction. For heating fluid coming in from the periphery to its channel(s) in the heat exchanger, the heating fluid will try to keep its high peripheral speed, so that the heating fluid will move relatively with the rotation direction and in the opposite direction of the cooling fluid, which increases the heat exchange effect. More circular heat exchangers can be connected in series inward towards the rotation axis.

The circular heat exchangers can be arranged with several tubes of different diameter (not shown), where the larger surrounds the smaller, and they surround and are centered in the entire length around the shaft/axis of rotation with centered discs on the shaft, and the discs that supports and are arranged to each shafts end of the pipes, which seal between the gases and the outside. The discs that can be put together of one or more of the required tracks to form the radial channels and which put the fluids in rotation, and leads the fluid from the space between two pipes, also the space between the innermost tube and the shaft forming channels for fluids. Shafts can also be a pipe as said. The fluids flowing through the pipes resultant tangential/axially, and further the fluids will move from the end of its pipe radial outward/inward to their next heat exchanger pipe channel that is radial outside/inside the second fluids channel, or the fluids is led out/into the rotation shaft. By counter flow heat exchanging outward toward periphery in this case, the fluids start in the pipe channel closest to the shaft/rotational axis and the second fluid starts in a pipe channel radials outside, and the fluid within coming out of this, and so on. The fluids will move axially the opposite way in relation to the pipe channels they came from. After a number of pipe channels the fluids will ramify into their insulated channels radial from each of its axial side at the periphery inward towards the rotation axis back at its inlet where the fluids can flow through the said end heat exchangers of the rotation device's shaft ends which they are arranged and supported against, where the heat exchangers also is mounted and supported against the outer surface of said disc/discs on the shaft end, and each heat exchanger is divided with an axially channel divider pipe which is also attached and supported to the said discs, and the divider pipe is arranged between the inner side of the cylindrical heat exchanger and the shaft/rotational axis where it is an equal axially cross-sectional area of the said pipe's radial space in the outer and inner side, the same area is also in the opening between the end of the pipe section and the end of the heat exchanger.

This forms a flow channel in the heat exchangers, where the fluid comes in from the U-channels heat exchanger in the outer channel to the end of the heat exchanger, and then headed radial inward, and further axially to the center channel back in to the U-channels to a new heat exchanging outward towards the periphery and in a closed circuit as said. In the innermost pipe channels outward towards to the periphery the residual fluids heat/cool heat exchanges towards each other so that they get an equal temperature before they are headed further in their pipe channels outwards toward the periphery where one fluid becomes warmer and so forth as said earlier. The sum of these combinations will both provide a relatively large over surface area and that the fluid may have a higher flow rate and pressure. Compression for motion of the cooling fluid can be performed as said earlier, or as said below. Bearing, low pressure/vacuum within the evacuated housing and sealing of this, and the rotation of the rotary device can be as described earlier or later.

Inside the said internal ends of the heat exchangers' centre channels, where an axial turbine could be arranged to compress and move the cooling fluid, and compression from the heating fluid may energy convert (not shown). And when the device is to be absolutely tight to perhaps use the volatile gases, it can be connected to the turbines shaft radial a number of magnets/electromagnets that is arranged against the heat exchanger's tight end lid with little clearance, and when the end cap is of a material that allows magnetic field to pass, it is on the outer surface of end cap held an equivalent number of electromagnets with the same radial distance as the magnets on the other side of the end cap, and the magnets on each side will be left over right for each other and the magnetic contact to drive the turbines when the outer surface of magnets are connected to a appropriate funds for the rotation and a energy converting which for the cooling fluid's side can be an electric motor, and for heating fluid's side an electrical turbine generator which will rotate in the same way as the rotation device in a higher speeds which generate electricity to the cooling fluid's electric motor which operates its turbine against the rotation direction of the rotating device. For optimal flow between the fluids one may regulate to provide added electricity in a adjusted amount from the external source for the electric motor of the cooling fluid while simultaneously the electricity from the generator of the heating fluid decrease in a adjusted amount. Such turbines may rotate the opposite as said, or in the same direction—, or with the rotation device in higher speeds, and the last case will be able to perform the rotation of the rotary device with the U-channels when added extra electricity to the cooling fluid's electric motor, or other suitable rotation means supplied energy. This is when the other criteria to reduce the rotation resistance are fulfilling, as said earlier and later.

To achieve the highest possible heat exchange area, and optimally in relation to the lowest possible flow resistance that can provide a higher flow through, the U-channels' heat exchangers 106 can form a conic shape which surrounds and are centred around the shaft, where the inlet 101, 102 is from the pointed end, and the blunt end outwards towards the periphery 107, where a blunt end of the conic shape of riser channels are connected to and are insulated from each other and headed conic inwards to the outlet 111, 112. The conic shapes can be made up of at least three equally long conic tubes for each shaft end with the blunt ends facing each other, and the pipes are in adapted dimensions, where they are in a row within each other by size against to the shaft, and the space between them forming a adapted cooling fluid channel which can be radial outermost, and then the heating fluid go in the channel in the space radial within. The pipes can be supported/attached to the shaft and centred with a variety of shovels, and where the shovels lies, or is attached to the inner side of the inner tube, the same in the radial direction outwards the fluid channels be attached shovels outside which puts the fluids in rotation, and that the pipes is supported and strengthened.

The presented invention can include two static and hollow shafts/pipes 103, 110 (not shown) that do not rotate and is fixed to a reinforced axial regulator for each shaft on both sides of the U-channel structures and with the bearing laid on the ends of the said static shaft and built centred on the rotation axis towards the outer surface of the supporting U-channel structures 107, and inside the said hollow shaft ends 103, 110, it is built and centred a static channel which forms the inlet channel 101 for the heating fluid on one side—and the outlet channel 111 on the other side of the U-channel structures, and the space between the inner side of said hollow static shaft ends and outside of the heating fluid channel 101, 111 forms the inlet channel 102 for the cooling fluid on one side—and the outlet channel 112 on the other side of the U-channel structures, and at the end of said inlet channel 101, 102 it is mounted adjustable stator blade which is adapted to control the pressurized inlet fluids in the rotation direction to the U-channel structure of the inlet side to execute an adapted rotation, and at the inlet and outlet of the U-channels it is mounted shovels completely or partially bent backward towards the rotation direction, and beyond the shovels at the end of said outlet channels 111, 112 it is mounted stator blade adapted to control the pressurized outlet fluids along the outlet channels, and mentioned protection house is mounted with a sealing on the said axial regulator which adapts the shaft axially on each side of the U-channel structures. Or sealing is built between the rotation device for U-channels and at the centre openings of the evacuated housing.

In the presented invention with the cooling fluid in a closed system where pressurized argon or similar heavy gas with low cp can be used, and the heating fluid in an open system where air can be used, so the heated heating fluid/air from the periphery may heat exchange in the cooling fluid's heat exchanger beside, or outside the heating fluid's outlet. At the optimum heat exchanging the heating fluid will be delivered further pressurized at surrounding temperature. The same happens if the opposite cooling fluid is air, and pressurized hydrogen or helium or other suitable gas is heating fluid in a closed system which heats up the cooling fluid at the outlet, and now the said turbine for heating fluid can be connected as said, to an axial compressor which compresses the air/cooling fluid to the inlet. And the rest energy of rotation can be connected to the axial compressor's other shaft side. This creates a very effective thermal compressor in both cases which, also with advantage, could be connected before the fluid's inlet, or integrated in other thermo dynamics devices.

The presented invention can be connected in series, where it may be heat exchanging for both heat and cooling fluid to external/internal heating/cooling between one or more of the steps in the series, and that several serial links can cross heat exchange between steps in a series link for either lower—or higher temperature and pressure increase for at least one of the fluids.

The invention can also a liquefied heating fluid which can be adapted to a mixture of ammonia and water with a low boiling point or other suitable liquefied fluids, which phases over to steam/gas at the beginning of its rise channel at the periphery, if there is sufficient temperature difference against the cooling fluid, and boiling point is achieved in relation to the pressure formed at periphery, in the rise channel and to the outlet of the heating fluid, which then can be supplied at high pressure through a turbine, where heating fluid can condensate to liquid again at the expansion and by a possible heat exchange from some of the cooling fluid before or after the turbine. To limit the pressure and to adapt the pressure against the periphery of the liquid and its boiling point in relation to the temperature which the cooling fluid has achieved, the water mirror in the liquid can be adapted to a radial height from the periphery that are relative to the vapor pressure which is formed, and the liquids pressure, acting as a piston against the lighter steam with lower centrifugal force. The water column can also be adapted to form a low pressure at the inlet and the liquid can be condensed with the cooling medium from a suitable radial point in the heat exchanger and inwards towards the heating fluid's inlet where the cooling fluid's temperature can be equalize with the heating fluid and may return in the closed circuit, or it bring heat to the rotation device from the surroundings, or heat from an external source, and the heat plus compression heat towards periphery to heat exchanger there, ore it now can be a counter flow heat exchanger from shaft end to shaft end via periphery, the heating fluid can now also be a bit up in its rise channel.

The suspended bearings of the rotational device's U-channels can be with adapted rolling bearings, gliding bearings, magnetic bearing.

The rotation device can be arranged with a self-rebalancing mechanism, which can be at least one circular channel centered and transverse around the rotation axis, which is half filled with a suitable liquid or compact ball in metal ore similar.

Compression energy before the inlet of the cooling fluid to compensate for higher density in its rise channel will be significantly lower, compared to traditional compression with cooling and expansion of the cooling fluid at the same temperature difference. Since relatively minimal energy is required to achieve the pressure and temperature in the cooling fluid in the channels at the periphery with the rotation, and higher average mass density in the cooling fluid's rise channel towards the sink channel compensated by compression before the inlet to both increase the density and pressure, and that with same direction flow heat exchanging the cooling fluid will be cooled continuously outward towards the periphery which theoretically will give 50% energy reduction of the compression work of the inlet, against heat exchanging which is performable only at the periphery.

But on the other hand heat exchanging can only be executed at the periphery, when the said expansion work from the heating fluid's turbine can be completely or partially converted to the compression of the cooling fluid's compressor before the inlet where additional compression energy can be applied on the same axle, and it is then in any case little supplied energy which is needed to maintain the circulation of fluid and rotation of said turbine/compressor and the rotary unit with U-channels, and the said axial pipe channels with discs surrounding the shaft can be used, in which three pipes forming two Axial heat exchanger channels for fluids at the periphery. And the fluids sink channels and rise channels are thermally insulated from each other. Both pressure and temperature in the heating fluid at the outlet will increase, and vice versa it will at the cooling fluid's outlet theoretically be both lower pressure and temperature, but it is compensated with the pressure from the compressor from the inlet. At a closed system for both fluids can rest heat/cold for heat exchanging with the environment, equalize as said in the 2 like axial pipe channels at the rotation axis, before the fluid insulated is leaded in their sink channels towards the periphery heat exchanger. In this case, it is beneficial to counter flow heat exchanging as said. And if only one of the fluids is pressurized adapted in a closed system here, and depending on the fluid in the closed system, it is with an open system in the other U-channel with gas or ambient air from either a cool or heating fluid led from the periphery through a channel out of the rotation axis, where the gas/air is supplied as either cold or hot, or the fluid heat exchanges against the other fluid's outside/end heat exchanger where heat exchanging from the periphery becomes equalized, and pressurized the fluid is led at a ambient temperature which can be continued in a number of similar devices with the same method connected in series which generates the pressure. This gives a very clean and efficient thermal compression. At the last step in the series the fluid can be heated from a cooling fluid in the closed system which produces the cold to the ambient, and now the fluid from the inlet of the series is a heating fluid which is warmed further up at the periphery which increases the temperature and pressure at the outlet which can be energy converted. If there is a heating fluid in the closed system as heat exchanger to the ambience in the same way as in the last step.

Then the fluid in the series will be a cooling fluid with an adiabatic expansion from the periphery to the outlet where the cooling fluid then passes an axial turbine for energy utilization, and the cooling fluid could become so cold that the gases may fractionated afterwards. For example CO2 if the cooling fluid was exhaust. By the said cross-coupling series, it is in this way possible to cool the gases so much, that most of the gases can be fractionated with this method and apparatus.

At a closed system, in the beginning of the rotation start, it will in the channels which are not affected by the centrifugal, force form a low pressure and temperature fall, which depends on the volume of these channels against to the volume of channels beyond towards the periphery. But after a period of circulation of fluids which they receives heat, the fluid's temperature will stabilize and eventually receive or give up heat, as said. Depending on the fluids density and compressibility, the volume in channels outside of the centrifugal force must be adapted in volume to avoid adverse dilution of the appropriate fluid which reduces the heat exchange from these channels and heat exchangers. It may therefore be beneficial to use heavy and pressurized fluid such as from/to the shaft ends and through the said external circuit and the heat exchanger and after this that the appropriate fluid passes an accumulation tank, where it also may be a heat exchanger arranged. For cooling fluids, as this it will be most appropriate for, the compressor can also be arranged between the heat exchanger and pressure tank. By use harmless fluid, such as argon, a limited leakage may be allowed at sealing of the shaft's inlet and outlet for fluid at the operation. And refilling/supplementing could be executed to the pressure tank of an adapted cross-coupled series of rotation apparatus which fractionated out argon from the ambient air as said.

At the high g and the pressure which the heat exchange is carried out in. The convection speed and turbulence will lead to a higher heat exchange effect, which requires less area against 1 g solutions.

Cooling fluid which will be colder after the outlet in relation of what it was before the inlet, and because the cooling fluid will be heated by the pressure toward the periphery, it must be compressible, and it is beneficial if the cooling fluid also has high mass density and a high adiabatic exponent/low cp, and some fluids that may be relevant, and which may be heated before the inlet are: —Air that does not require recycling. —Argon as recyclable. —Or fluid used in today's heat pumps and in a closed cycle.

Heating fluid which will be warmer after the outlet in relation of what it was before the inlet, and since the heating fluid is not to be, or limited heated up by the pressurizing toward the periphery, it should not be/or to a lesser extent compressible of the centrifugal force, and it is beneficial if the heating fluid also has a low mass density and low adiabatic exponent/high cp if it is compressible and some fluid that may be relevant are:—Water that does not need to recycle, but the water creates a high hydrostatic pressure, and the heating fluid channels around periphery must have a minimal cross-sectional area to avoid massive structure which restricts the heat exchanging, or water column from the periphery is low, or the water fog is atomized directly in the cooling fluid.—Light gases such as hydrogen and helium will provide relatively small pressure increase towards the periphery, and thus lower the temperature against the cooling fluid if they have the same temperature at the inlet.—Air, or any fluid if the heating fluid is colder than cooling fluid at the periphery, and the heating fluid can be refrigerated adapted before the inlet to and achieve this, and that can be performed with some of the cooling fluid from the outlet to indirectly heat exchanging.

ADVANTAGES OF THE INVENTION

When the present invention also can provide heat, cold and pressure without phasing over from/to a liquid fluid. In the cycle/process the current invention will thus have a greater flexibility, and the use of environmentally friendly gases such as air. The invention also have a higher efficiency, less complex, more reliable, more compact, less expensive in production and operations against know systems to day.

When the outlet is at the rotation axis the velocity of the fluids can be lower against that they are sent over the periphery, this provides less friction and are more effective, even when fluids tangential retarding from the periphery and inward, that will get in balance with tangential acceleration outwards towards the periphery. It can only be heating of the heating fluid at the periphery from the cooling fluid which runs the circulation of the heating fluid.

Then the rotating device is arranged and enclosed in an evacuated housing (not shown), will it then be minimal rotation resistance, noise and heat-loss. With suitable seals, will there be few percentages of the total energy needed to maintain a low pressure and constant rotation. The device is compact and with few mechanical moving parts which provides a low maintenance frequency. In the invention the produced pressure in the fluid out of device can be energy utilized.

The present invention can be produced of materials with the required strength to withstand the forces arising from the rotation at high speed, and pressure in the channels. The structure should have low mass density to limit the above-mentioned forces. The structure can be designed in metal, or from a ceramic, or composite, or nano technical material, or a combination of these. Heat exchangers should have high thermal conductivity, and channels outside of this must be thermal insulated from each other with appropriate materials. The centrifugal forces set the rotation speed and the diameter of U-channel structures, which are adapted to the forces which are allowed for the materials in use.

The figures must be seen as schematic drawings illustrating the principles of the invention only, and not necessarily showing real world physical realizations of the invention. The invention may be realized using many different materials and arrangements of its components. Such realizations should be within the abilities of any person skilled in the art.

EXAMPLES

Example 1

The calculation below shows an example of theoretical temperatures for Hydrogen and Argon in a closed system with heat exchanging at the periphery, and at a peripheral speed (vp) 400 m/s. 1=inlet. 2=periphery. 3=outlet. As the flow-speed in the fluid channels can be relatively low, is resistance, pressure and temperature fall in a few percentages, and thus are neglected.

$\Delta T1-2=\Delta T3-2$ With same cp. (cp=heat capacity at constant pressure)

$vp$=400 m/s, cp $h2$=14320 J/kg K, cp Ar=520 J/kg K $\Delta T\ h2(1-2)=vp^2/(2\times cp)=400^2$ m/s/(2×14320 J/kg K)=5.6 K $\Delta T$ Ar$(1-2)=vp^2/(2\times cp)=400^2$ m/s/(2×520 J/kg K)=154 K At the same mass cp maximal heat exchange in T is equal to:

$T$=(((ΔAr−(Δ$Th$2×cp masse Ar)/(cp masse $h$2)))/2=(154K−5.6K)/2=74.2 K

This means that the $h_2$ can be delivered 74.2 K warmer than the ambient from its heat exchanger on one shaft end, and on the other shaft end the argon is 74.2 K colder in its heat exchanger than the ambient.

Example 2

By using air as a heating fluid in an open system as a heat exchanger to argon as the cooling fluid pressurized in a closed circuit with twice the mass cp=(1000×2 kJ/kg K)/(520 kJ K)=3.85 in heat exchanger 106.

$vp$=400 m/s, cp luft=1000 J/kg K, cp Ar=520 J/kg K $\Delta T$ Ar$(1-2)=vp^2/(2\times cp)=400^2$ m/s/(2×520 J/kg K)=154 K $\Delta T$ air$(1-2)=vp^2/(2\times cp)=400^2$ m/s/(2×1000 J/kg K)=80 K ±Δ$T$=(((ΔAr−(Δ$T$ luft×cp mass air)/(cp mass Ar)))/2

±Δ$T$=(((154K−(80K×1000 J/kg K)/(3.85×520 J/kg K)))/2=57K

This means that the air is 57K warmer than the ambient and the Argon is 57 k colder than ambient at outlet in its heat exchanger, and the airs have to be supplied pressurized to periphery for heating.

But if the air under constant pressure is cooled by argon through its heat exchanger at or outside the outlet, will both air and argon have little more T as the ambient and the air is supplied pressurized to the environment's T. And at a isentropic exponent (k)=1.4. And T ambient air=291 K and 1 bar. Will then the air be delivered hot or cold at the followed pressure:

$T$2 air=291K+80K+57K=428 K,

This give $p$2=1 bar×((291K+80K)/291K))^(1.4/(1.4−1))=2.34 bar.

And heating at $T$1−2 give $p$3=2.34 bar((428K−80K)/428K))^(1.41(1.4−1))=1.134 bar Heated, or to the ambient T where the air is pressurized forward in a row of series connected similar devices. When the pressure ratio=p3/p1=1.134 is also in each step of the series connection when the cp is equal in every step. Thus the number of steps may be in power of the pressure ratio in the first step. So at example at 10 steps in series.

P3 at 10. step=1.134^10 bar=3.52 bar With few K over the ambient air T.

The invention claimed is:

1. A device for transporting heat between a cooling fluid and a heating fluid, comprising:

at least two suspended U-channel structures arranged radially and in balance around a rotation axis, wherein each U-channel structure includes a number of U-shaped channels that lead from the rotational axis to a periphery of the device and back again, the U-channels being connected to respective inlet and outlet channels for transport of said fluids through the U-channels, wherein one of the channels contains the cooling fluid where heat is developed due to centrifugal compression in the channel, the heat being transferred to the heating fluid with lower temperature in the second channel, the heating fluid before the outlet being pressurized by the heat received from the heat exchanger, wherein the cooling fluid is pressurized before the inlet, the channel containing the cooling fluid includes a cooling fluid sink channel and the channel containing the heating fluid includes a heating fluid sink channel, the cooling fluid sink channel and the heating fluid sink channel being parallel and adjacent, and the device further comprises a heat exchanger between the cooling fluid sink channel and the heating fluid sink channel to transfer heat there between.

2. The device according to claim 1, further comprising:

a shaft suspended in bearings that supports said U-channel structures, which includes the inlet channels which branch into a plurality of sink channels which form an equivalent number of heat exchangers that lead from the shaft by the U-channel structures to the periphery, said inlet channels supplying fluid to said heat exchangers.

3. The device according to claim 1, further comprising:

a plurality of rise channels for the cooling fluid and the heating fluid which are connected to a corresponding number of sink channels for current fluid at the periphery by said heat exchanger, and the rise channels are adapted to remove current fluid from the heat exchangers, wherein the rise channels are connected to the outlet channel of the cooling fluid and of the heating fluid in the shaft.

4. The device according to claim 1, wherein a liquid fluid is added in atomized form directly to the cooling fluid from the inlet and outwards to the periphery where the liquid is separated out of the cooling fluid, and conducted further on throughout the periphery with precipitated material and some cooling fluid.

5. The device according to claim 1, further comprising:

at least one heat exchanger between the outlet and a pressure energy converting device for at least one of the fluids.

6. The device according to claim 1, where there are no nozzles nor an ejector diffusor at the periphery.

7. The device according to claim 1, where said heat exchanger is a counter flow heat exchanger.

8. The device according to claim 4, further comprising:

an anchored protection chamber with low pressure inside, which is arranged in bearings against the shaft, and sealing against the U-channel structure at the inlet and outlet, a protective casing enclosing said U-channel structures, and a disc-shaped ejector diffusor fastened to the protective casing and arranged outside of the nozzle row of the rotation device to receive material therefrom, and which also produces low pressure inside the protective casing.

9. The device according to claim 4, further comprising:

at least one disc- or pipe-like heat exchanger which is transverse on and centered around the rotation axis, and containing at least one circular channel for the cooling fluid and at least one circular channel for the heating fluid, where the cooling fluid supplying channel from the inlet branches out towards the heat exchanger and couples to the cooling fluid channel in the heat exchanger closest to the rotation axis, and further is connected in the periphery from the cooling fluid circle channel in the heat exchanger in channels branching in towards the rotation axis and the outlet, and where the heating fluid supply channel branches out from the inlet outwards to the heat exchanger and in the periphery connects to the heating fluid channel in the heat exchanger, and connects nearest the rotation axis from the cooling fluid circle channel in the heat exchanger in channels that branch in towards the rotation axis and to the outlet.

* * * * *